United States Patent [19]

Giuffrida et al.

[11] Patent Number: 4,785,499

[45] Date of Patent: Nov. 22, 1988

[54] DOOR SHOE FOR GLASS DOORS

[76] Inventors: Salvatore Giuffrida; John Giuffrida, both of 28 Catherine Ave., Franklin City, N.Y. 11010

[21] Appl. No.: 151,287

[22] Filed: Feb. 1, 1988

[51] Int. Cl.[4] ..... E05D 7/04

[52] U.S. Cl. ..... 16/241; 16/245; 49/381; 49/386

[58] Field of Search ..... 49/381, 386, 388; 76/241, 245

[56] References Cited

U.S. PATENT DOCUMENTS 1,169,283 1/1916 Peterick ..... 16/241
2,530,331 11/1950 Hubbs ..... 16/245
3,101,507 8/1963 Cecala ..... 16/241
3,325,942 6/1967 Bejarano ..... 49/388 X

*Primary Examiner*—Kenneth J. Dorner
*Assistant Examiner*—James R. Brittain
*Attorney, Agent, or Firm*—Myron Amer

[57] ABSTRACT

A so-called shoe for a glass door embodying a mechanism for making adjustments in the position of pivotal traverse of the door relative to the door opening and also in the lateral position thereof, said pivotal traverse position components of said mechanism including a cam means to selectively load and unload a spring to allow said spring to correspondingly urge said door in opposite directions of pivotal traverse for providing said door with an adjusted position in said door opening.

3 Claims, 2 Drawing Sheets

DOOR SHOE FOR GLASS DOORS

The present invention relates generally to improvements in door shoes for glass doors, and more particularly to mechanisms in the shoe for effectively negating any misalignment or faulty position of the door in its door opening. A significant aspect of the within inventive shoe is that adjustments in the door position are possible in all necessary directions, are easily effected using only a screw driver, and the adjusting mechanism is provided without detracting from the appearance of the door.

THE PRIOR ART

To be comparable with the modern look of glass doors of the type provided in office buildings, it is common to use a chrome door shoe which houses the necessary mechanisms to adjust for misaligned or faulty door positions. In most known chrome door shoes however, the screws for adjusting the door position is in the front of the shoe and, in this position, detracts from the appearance of the door.

Efforts to avoid conspicuous adjusting screws have not been entirely satisfactory because they have resulted in less effective door-adjusting mechanisms.

EXAMPLES OF THE PRIOR ART

U.S. Pat. No. 3,101,507 issued on Aug. 27, 1963 to M. L. Cecala relates to making adjustment in the position of door 10 in the door opening 23 without exposed adjustment screws. As best shown in FIGS. 2 and 5, and as explained in col. 4, in lines 30–43, rotation of nut 27 on threaded shaft 45 moves arm 11 left or right (as viewed from above) to make the necessary adjustment, and the opposite ends of shaft 45 are not externally visible. However, the mechanism just described can only be located in the top of the door, as distinguished from the bottom, since access to nut 27 must be from above when the door is partially open (col. 4, lines 44–49).

Also pertinent is U.S. Pat. No. 3,325,942 issued on June 20, 1967 to Bejarano in which, as explained at column 2, starting in line 46, a screwdriver inserted through a rear edge door opening produces door position adjustments. However, the door adjustment in Bejarano is vertical, rather than in its position of rotation relative to a vertical axis.

As will be explained in greater detail subsequently herein, the inventive door shoe has inconspicuous adjusting screws (70 and 74) and also allows for adjustments through pivotal traverses of the door, and thus not just in its limited vertical movement as provided in Bejarano.

The improvement over prior art devices achieved by this invention is that the camming which produces door movement is against a compressible spring, such that it is in effect the spring, and not the cam, which urges the door through adjusting movements. Thus, unlike Bejarano which relies on the cam to directly produce door movement, and is thus restricted to vertical door movement, the inventive door shoe can, and does effectively produce pivotal traverses in the door.

In practice it also has been found that the compressible spring in the door shoe absorbs vibration and shock which unavoidably results even during normal use of the door.

The description of the invention which follows, together with the accompanying drawings should not be construed as limiting the invention to the example shown and described because those skilled in the art to which this invention appertains will be able to devise other forms thereof within the ambit of the appended claims.

Figure 5:
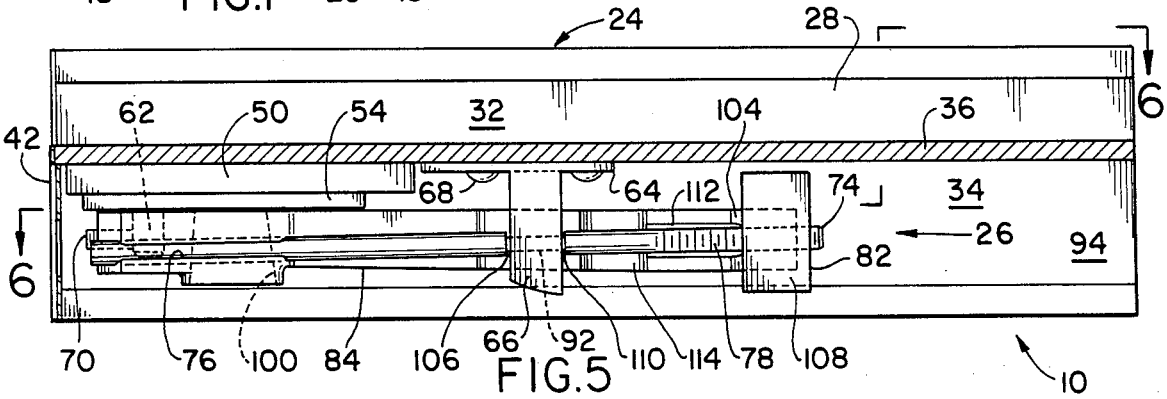
FIG. 5 is a longitudinal sectional view as taken along line 5—5 of FIG. 3.
Figure 6:
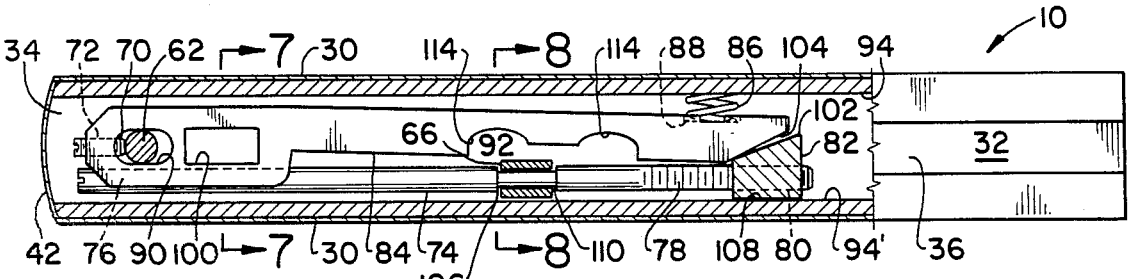
Figure 7:
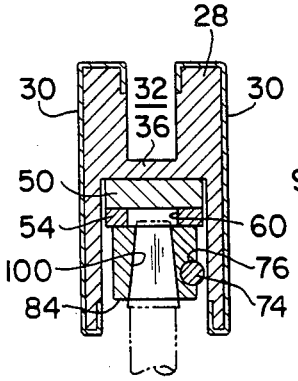
Figure 8:
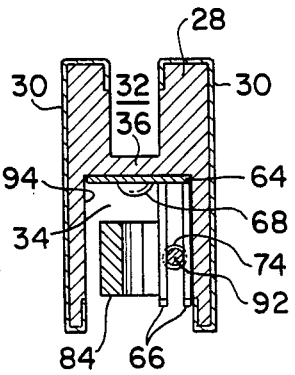

FIG. 6 is a plan view, partially in section, as taken along line 6—6 of FIG. 5; and FIGS. 7 and 8 are sectional views, as taken respectively along lines 7—7 and 8—8 of FIG. 6.

Figure 1:
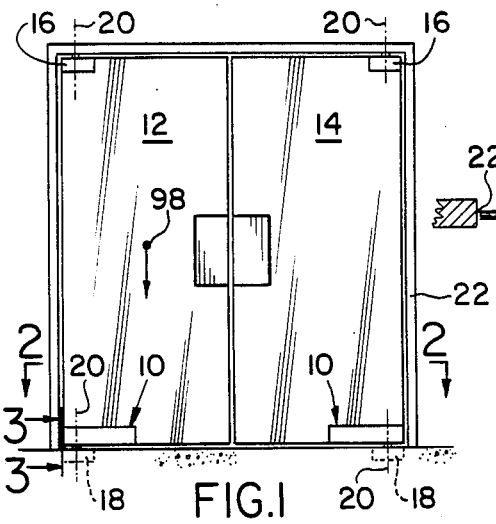
FIG. 1 is an orientation figure of a double door in front elevation in which the within inventive door shoe is used on each of the doors.

In FIG. 1 the within inventive so-called door shoe or device 10 is shown installed on a pair of glass doors 12 and 14. Both doors 12, 14 have an upper pivot of conventional form and an in floor, hydraulic floor check 18 well known in the industry. Pivot 16 and check 18 have a common vertical operating axis 20. As an alternative to the FIG. 1 installation device 10 could also be used on each of single or multiple doors within an appropriate jamb 22.

For present purposes it suffices to describes the device 10 as used on door 12.

Figure 2:
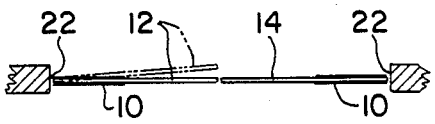
FIG. 2 is a sectional view of the doorway as taken along line 2—2 of FIG. 1.

Briefly, the function of floor check 18 is to allow door 12 (and/or 14) to be easily opened in either direction, and then slowly return the door to its closed position as seen in FIG. 2. Floor check 18 has a tapered, rectangular, male extension 18' (shown in phantom line in FIG. 4) which engages door shoe 10.

Figure 4:
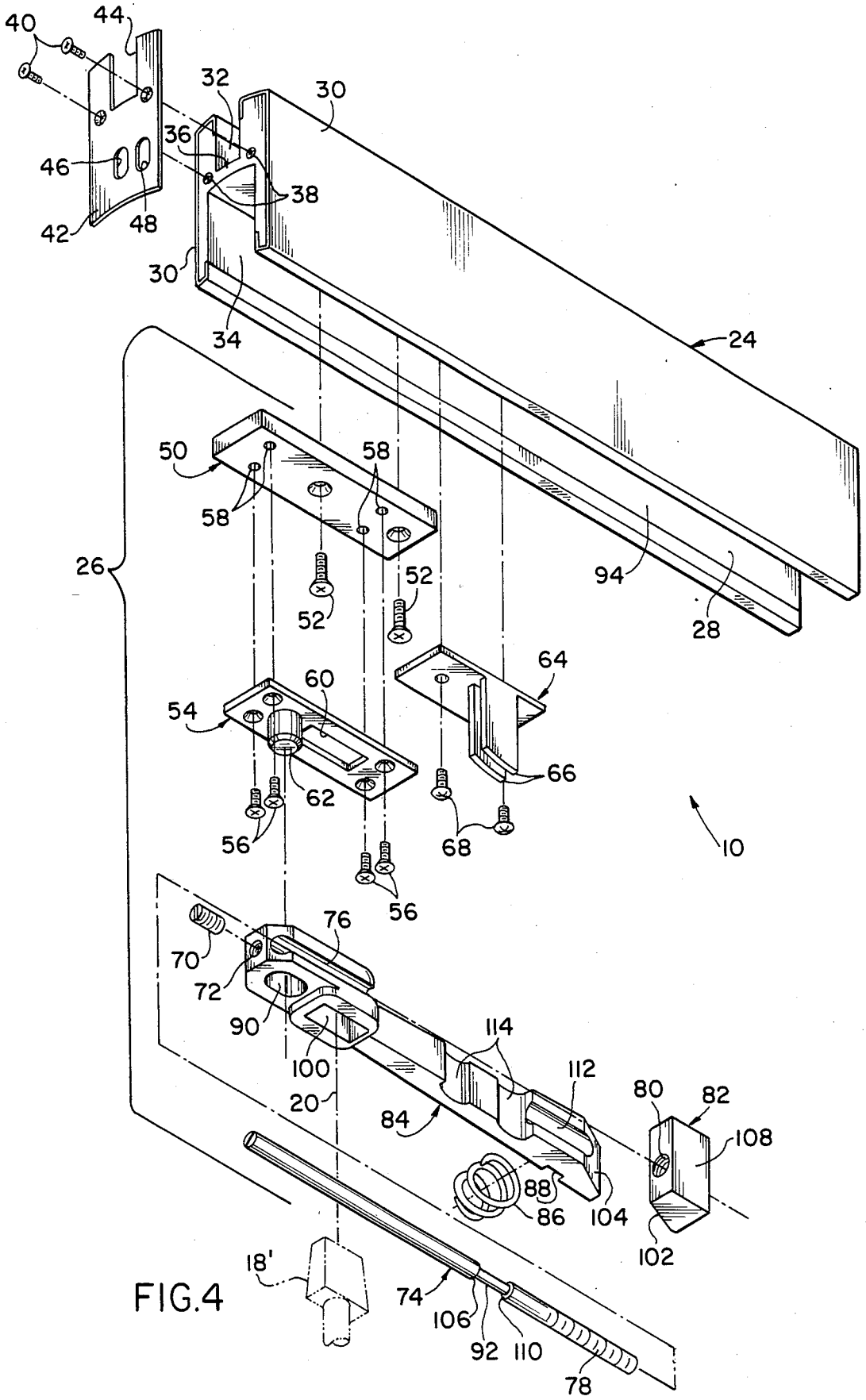
FIG. 4 is an exploded isometric view of the door show as seen from the underside.

Referring to FIG. 4, the inventive door shoe 10 consists of an array 26 of hardware components fastened and positioned relative to a main chasis 24. Chasis or housing 24 is an elongated H-shaped member 28 clad on both sides with a protective, chromed sheet metal covering 30 which contributes to enhancing the appearance of the glass doors 12, 14. The top side of the H member 28 has therein an upper channel 32 into which the glass of door 12 is cemented or otherwise secured. The lower channel 34 of the H member 28 is reserved for the installation of the hardware array 26. Separating channels 32 and 34 is web 36. On the arcuate, pivot end of member 28 (i.e. adjacent door axis 20) tapped holes 38 receive screws 40 to secure plate 42 thereon. Plate 42 has a slot 44 to match and align with channel 32 and also screw access holes 46 and 48 therein.

First to be installed within the lower channel 34 is a shim block 50 which is held in place by screws 52. Screws 52 engage tapped holes (not shown) in web 36. The thickness of shim 50 should be designed to raise or lower door 12 to accomodate threshold members or floor covering. Next to be installed is pin plate 54, and this is done using screws 56 which are engaged in tapped holes 58 in block 50. Slot 60 provides clearance for the uppermost end of floor check extension 18' (see also FIG. 7). Fastened on and integral with plate 54 is pin 62. Following the installation of plate 54 is the installation of straddle plate 64. Plate 64 has two dependent legs each designated 66 and is fixed to web 36 by screws 68 which engage tapped holes not shown.

The remaining components of array 26, namely arm 84, rod 74 and block 82, are now loosely assembled as a separate group and then placed within channel 34. More particularly, screw member 70 is threaded into the tapped hole 72 of arm 84. Rod 74 can be passed through open bore of arm 84 and the lead screw section 78 thereon can be engaged in tapped hole 80 within wedge block 82. Spring 86 is placed against spot face seat 88 on arm 84. Now, this group of parts, i.e. arm 86, screw 70, rod 74, wedge block 82 and spring 86, in a loosely assembled condition, is positioned within channel 34 of main chasis 24. The assembly is manipulated so that elongated hole 90 in arm 84 aligns with pin 62 on the already secured pin plate 54 and the reduced diameter section 92 of rod 74 finds its way between legs 66 of the already secured straddle plate 64. Spring 86 will then become captive between arm 84 and the interior surface 94 of the channel 36, as shown in the plan view of FIG. 6. Care should be taken to retain all parts within channel 36 until the door 12 and shoe assembly 10 are positioned upon check extension 18' where gravity then functions to hold all parts intact.

After the door 12 has been "hung", it may be immediately apparent that certain misalignments have developed or, for whatever reasons are present, and have to be removed. It may for example be evident that door 12 is not parallel with jamb 22, or that door 12 comes to rest in the phantom line position (exaggerated angle) shown in FIG. 2 when in fact it is supposed to be fully closed.

To understand the correction of an assumed non-parallel condition, it is helpful to refer specifically to FIGS. 1 and 6. Door 12 is supported between upper pivot 16 and floor check 18 and has a center of gravity 98. Since the center of gravity 98 of door 12 is to the right of pivot 16 there is a clockwise moment about pivot 16. Pin 62 is effectively rigidly connected to door 12, and due to the above mentioned moment, is resisted by screw 70 which is effectively connected to floor check 18. That is, the clockwise moment or movement which it generates keeps pin 62 in contact with screw 70.

If space 96 is larger at the bottom, a counter clockwise turning of screw 70 will allow the bottom of door 12 to move slightly to the left. If space 96 is smaller at the bottom, a clockwise turning of screw 70 will push the bottom of door 12 slightly to the right. The appropriate adjustment can now be made to make door 12 parallel to jamb 22.

As previously mentioned a condition that might require correction is that shown in FIG. 2, wherein door 12 may not move to the fully closed position when it comes to rest as determined by floor check 18. Since the position of arm 84 is determined by floor check 18, via extension 18' which fits snugly in socket 100 (FIGS. 4, 5, 6 and 7), it is necessary to move arm 84 relative to door 12 or vice versa, to make the pivotal adjustment.

In FIGS. 5 and 6, the inclined face 102 of wedge block 82 is shown in a position where it just touches the inclined face 104 of arm 84. A clockwise turning of rod 74 would cause wedge 82 to move to the left as it is advanced along lead screw 78, while lead screw 78 is permitted only rotative movement since shoulder 106 in rod 74 bears against dependent legs 66 of the fixed plate 64. In FIG. 6, spring 86 is just about to be compressed. This is most likely the most common to be encountered relative condition of the parts when door 12 is out of adjustment (phantom line FIG. 2), and for correction requires a slight clockwise pivotal traverse in door 12 relative to floor check 18.

To move door 12 slightly into fuly closed position and through the referred to corrective traverse, it is necessary to rotate rod 74 clockwise. This action pulls wedge 82 to the left (as viewed in FIG. 5) and wedge face 102 engages arm face 104. Spring 86 begins to compress and wedge flat face 108 bears against the interior face 94' of channel 34. This action effectively pushes door 12 clockwise relative to floor check 18 and arm 84. Adjustment is made until door 12 is in its fully closed position.

Should pivotal misalignment occur in the direction opposite that just described, counterclockwise turning of rod 74 will drive wedge block 82 to the right via lead screw 78. In this case, shoulder 110 on rod 74 will come to bear on dependent legs 66 and spring 86 will decompress, slightly pushing door 12 counterclockwise relative to arm 84.

To recapitulate the making of the just described pivotal traverses in the door 12, it is to be understood that these traverses are relative to the arm 84 which is fixed in place and thus in a specific vertical plane by virtue of arm 84 being connected to the upstanding floor check 18. This corrective movement or pivotal traverses in door 12 is, of course, possible because the hardware array 26 is only disposed over the fixed arm 84 and not immovably connected to it. Thus, within a limited amount of clearance or "play", the hardware array 26 and thus door shoe 10 which contains the glass door 12, can be urged to the left or right of the specific vertical plane position of the arm 84, and this enables the door 12 to be placed in a proper closed position.

Figure 3:
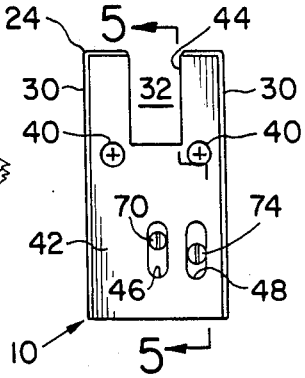
FIG. 3 is an end view of the door shoe as taken along line 3—3 of FIG. 1.

A significant aspect of the door position adjusting construction which contributes to the present invention is that it does not detract from the appearance of the chrome door shoe 10 and its cooperating glass door 12. That is, in contrast to the prior art, access to the door shoe adjusting mechanism (screw 70 and rod 74) is inconspicuously hidden in plate 42 on the pivot end of door shoe 10. As already described, screwdriver access to screw 70 can be gotten through hole 46 and to rod 74 through hole 48, as seen in FIG. 3.

Among other noteworthy features, it is to be noted that an undercut 112 in arm 84 eliminates possible interference with lead screw 78 and cutouts 114 provide screw driver access to screws 68 if need be.

While the particular door shoe herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In combination, a glass door of the type mounted to partake of pivotal traverses about a vertical axis adjacent an end thereof, and a door-positioning mechanism for making adjustments in said door pivotal traverses, said mechanism comprising a door support member positioned in supporting relation beneath said door and having a fixed axis coinciding with said door pivotal traverse vertical axis and extending laterally of said fixed axis, an H-shaped housing for said mechanism having a pair of upper legs bounding an upwardly facing channel and a pair of lower legs bounding a downwardly facing channel, said glass door having an operative position disposed in said upwardly facing channel, said lateral extension of said door support member being disposed in said downwardly facing channel of said H-housing for providing said H-shaped housing with an operative position in an unconnected covering relation thereover, a lead screw and cam means provided in said downwardly facing channel in an interposed position between a lower leg of said H-shaped housing and said laterally extending door support member, and a spring means also provided in said downwardly facing channel in an interposed position between an opposite lower leg of said H-shaped housing and said laterally extending door support member so as to urge said glass door in opposite pivotal traverses relative to said laterally extending door support member in response to the operation of said lead screw and cams means, whereby adjustments in the position of pivotal traverse of said glass door are made in accordance with the threaded adjustment of said lead screw which is accessible in the side of said H-shaped housing of said mechanism.

2. The mechanism for adjusting the position of pivotal traverse of a glass door as claimed in claim 1 wherein said laterally extending door support member has an upper opening therein and said mechanism includes a plate having a depending projection thereon having an operative position in which said depending projection projects into said door support member upper opening, and including a threadable member accessible from the side of said mechanism having an end thereon in contact with said depending projection, whereby threadable adjustment of said threadable member pushes against said depending projection to correspondingly urge said combination mechanism and glass door in laterally adjusted movement in addition to said adjustments in said door pivotal traverse position.

3. The door positioning mechanism as claimed in claim 2 wherein the threadably adjustable ends of said lead screw and of said threadable member are adjacent each other in said end of said mechanism pivotal about said vertical axis to thereby contribute to providing facilitated access to said threadably adjustable ends from a lateral direction relative to said door end, and wherein said adjustable ends are not conspicuous in a side of said H-spaped housing of said mechanism to thereby contribute to an enhanced appearance in said door positioning mechanism.

* * * * *